US010718346B2

(12) United States Patent
Hofer

(10) Patent No.: US 10,718,346 B2
(45) Date of Patent: Jul. 21, 2020

(54) APPARATUS FOR PRESSURIZING A FLUID WITHIN A TURBOMACHINE AND METHOD OF OPERATING THE SAME

(71) Applicant: General Electric Company, Schenectady, NY (US)

(72) Inventor: Douglas Carl Hofer, Clifton Park, NY (US)

(73) Assignee: General Electric Company, Schenectady, NY (US)

( * ) Notice: Subject to any disclaimer, the term of this patent is extended or adjusted under 35 U.S.C. 154(b) by 782 days.

(21) Appl. No.: 14/976,633

(22) Filed: Dec. 21, 2015

(65) Prior Publication Data

US 2017/0175754 A1 Jun. 22, 2017

(51) Int. Cl.

| | |
|---|---|
| ***F04D 29/28*** | (2006.01) |
| ***F04D 25/16*** | (2006.01) |
| ***F04D 29/08*** | (2006.01) |
| ***F04D 17/12*** | (2006.01) |
| ***F04D 29/051*** | (2006.01) |

(52) U.S. Cl.

CPC ..... *F04D 29/083* (2013.01); *F04D 17/122* (2013.01); *F04D 25/16* (2013.01); *F04D 29/051* (2013.01); *F04D 29/284* (2013.01)

(58) Field of Classification Search

CPC .... F04D 29/284; F04D 29/286; F04D 17/122; F04D 25/16

See application file for complete search history.

(56) References Cited

U.S. PATENT DOCUMENTS

| | | | | |
|---|---|---|---|---|
| 4,725,196 | A | 2/1988 | Kaneki et al. | |
| 4,778,334 | A * | 10/1988 | Medgyesy ..... | F04D 1/066 415/199.1 |
| 5,062,766 | A | 11/1991 | Miura et al. | |
| 5,445,494 | A | 8/1995 | Hanson | |
| 6,634,853 | B1 | 10/2003 | Anderson | |
| 6,948,314 | B2 | 9/2005 | Arnold et al. | |
| 7,021,891 | B2 | 4/2006 | Sanchez et al. | |
| 8,449,264 | B2 * | 5/2013 | Schwarz ..... | F04D 7/02 417/201 |

(Continued)

FOREIGN PATENT DOCUMENTS

| | | | |
|---|---|---|---|
| EP | 0270723 | A1 | 6/1988 |
| GB | 1300712 | A | 12/1972 |

(Continued)

*Primary Examiner* — Justin D Seabe

(74) *Attorney, Agent, or Firm* — Armstrong Teasdale LLP

(57) ABSTRACT

A compressor system includes a first compressor assembly including at least one first impeller. The first compressor assembly defines at least one first volute configured to receive a first working fluid from the at least one first impeller at a first pressure and a first temperature. The compressor system also includes a second compressor assembly rotatably coupled to the first compressor assembly. The second compressor assembly includes at least one second impeller rotatably coupled to the at least one first impeller. The second compressor assembly defines at least one second volute configured to receive a second working fluid from the at least one second impeller at a second pressure. Further, at least one of the following conditions exist, i.e., the first pressure is different from the second pressure and the first temperature is different from the second temperature.

10 Claims, 4 Drawing Sheets

(56) References Cited

U.S. PATENT DOCUMENTS

| | | | | |
|---|---|---|---|---|
| 9,169,846 | B2 * | 10/2015 | Mariotti | F04D 29/057 |
| 9,856,886 | B2 * | 1/2018 | Kares | F04D 17/122 |
| 2014/0105765 | A1 | 4/2014 | Tönnessen | |
| 2014/0119881 | A1 * | 5/2014 | Kalra | F01D 11/04 415/1 |
| 2015/0337851 | A1 * | 11/2015 | Hashizume | F16J 15/444 415/170.1 |
| 2016/0186764 | A1 * | 6/2016 | Lissoni | F04D 17/105 417/53 |
| 2017/0321713 | A1 * | 11/2017 | Clay | F04D 17/105 |
| 2018/0142694 | A1 * | 5/2018 | Daussin | F04D 17/12 |

FOREIGN PATENT DOCUMENTS

| | | | | |
|---|---|---|---|---|
| RU | 2448277 | C1 | 4/2012 | |
| WO | WO-2012124293 | A1 * | 9/2012 | F04D 29/284 |

* cited by examiner

APPARATUS FOR PRESSURIZING A FLUID WITHIN A TURBOMACHINE AND METHOD OF OPERATING THE SAME

BACKGROUND

The field of the disclosure relates generally to turbomachines and, more particularly, to methods and apparatus for pressurizing a fluid within turbomachines.

At least some known turbomachines operate in closed-loop systems, e.g., Brayton power cycles using working fluids including carbon dioxide ($CO_2$) at supercritical pressures and temperatures ($sCO_2$). Such known turbomachines typically exhibit enhanced thermodynamic efficiency benefits over conventional cycles with more conventional working fluids. These known turbomachines include a main compressor, a bypass compressor, and an expansion turbine rotatably coupled to a common rotor shaft and at least one recuperator coupled in flow communication with the main compressor, the bypass compressor, and the expansion turbine. This recompression cycle configuration for high temperature and high efficiency applications splits a fluid compression stream into two parallel paths with similar inlet and exit pressures, but the streams and the associated compressors operate at different temperatures. That is, the main compressor operates at a lower temperature and the bypass compressor operates at a higher temperature.

However, when compressing $CO_2$ to high pressures, i.e., typically in the range from and including 20 Megapascals (MPa) (2900 pounds per square inch (psi)) to and including 30 MPa (4351 psi), the density of the fluid may result in friction, i.e., windage losses on the rotating surfaces of the impellers of the compressors are induced. More specifically, compressor impellers in dense fluids such as $sCO_2$ experience high windage losses due to friction induced on the rotating back faces of the impellers. These losses are detrimental to the efficiency of the overall power cycle of the turbomachine and may be physically detrimental to the compressor impellers.

BRIEF DESCRIPTION

In one aspect, a compressor system is provided. The compressor system includes a first compressor assembly including at least one first impeller. The first compressor assembly defines at least one first volute configured to receive a first working fluid from the at least one first impeller at a first pressure and a first temperature. The compressor system also includes a second compressor assembly rotatably coupled to the first compressor assembly. The second compressor assembly includes at least one second impeller rotatably coupled to the at least one first impeller. The second compressor assembly defines at least one second volute configured to receive a second working fluid from the at least one second impeller at a second pressure. Further, at least one of the following conditions exist, i.e., the first pressure is different from the second pressure and the first temperature is different from the second temperature.

In another aspect, a turbomachine for use with a working fluid is provided. The turbomachine includes a rotatable shaft and a compressor system coupled to the rotatable shaft. The compressor system includes a first compressor assembly including at least one first impeller. The first compressor assembly defines at least one first volute configured to receive a first working fluid from the at least one first impeller at a first pressure and a first temperature. The compressor system also includes a second compressor assembly rotatably coupled to the first compressor assembly. The second compressor assembly includes at least one second impeller rotatably coupled to the at least one first impeller. The second compressor assembly defines at least one second volute configured to receive a second working fluid from the at least one second impeller at a second pressure. Further, at least one of the following conditions exist, i.e., the first pressure is different from the second pressure and the first temperature is different from the second temperature.

In another aspect, a method of pressurizing a working fluid within a turbomachine is provided. The turbomachine includes a rotatable shaft. The method includes rotating the rotatable shaft including rotating a first compressor assembly including at least one first impeller and rotating a second compressor assembly. The second compressor assembly includes at least one second impeller rotatably coupled to the at least one first impeller. The method further includes channeling a first working fluid having a first temperature to the at least one first impeller and pressurizing the first working fluid to a first pressure and at least one of channeling a second working fluid having a second temperature different from the first temperature to the at least one second impeller and pressurizing the second working fluid to a second pressure different from the first pressure.

DRAWINGS

These and other features, aspects, and advantages of the present disclosure will become better understood when the following detailed description is read with reference to the accompanying drawings in which like characters represent like parts throughout the drawings, wherein.

Figure 1:
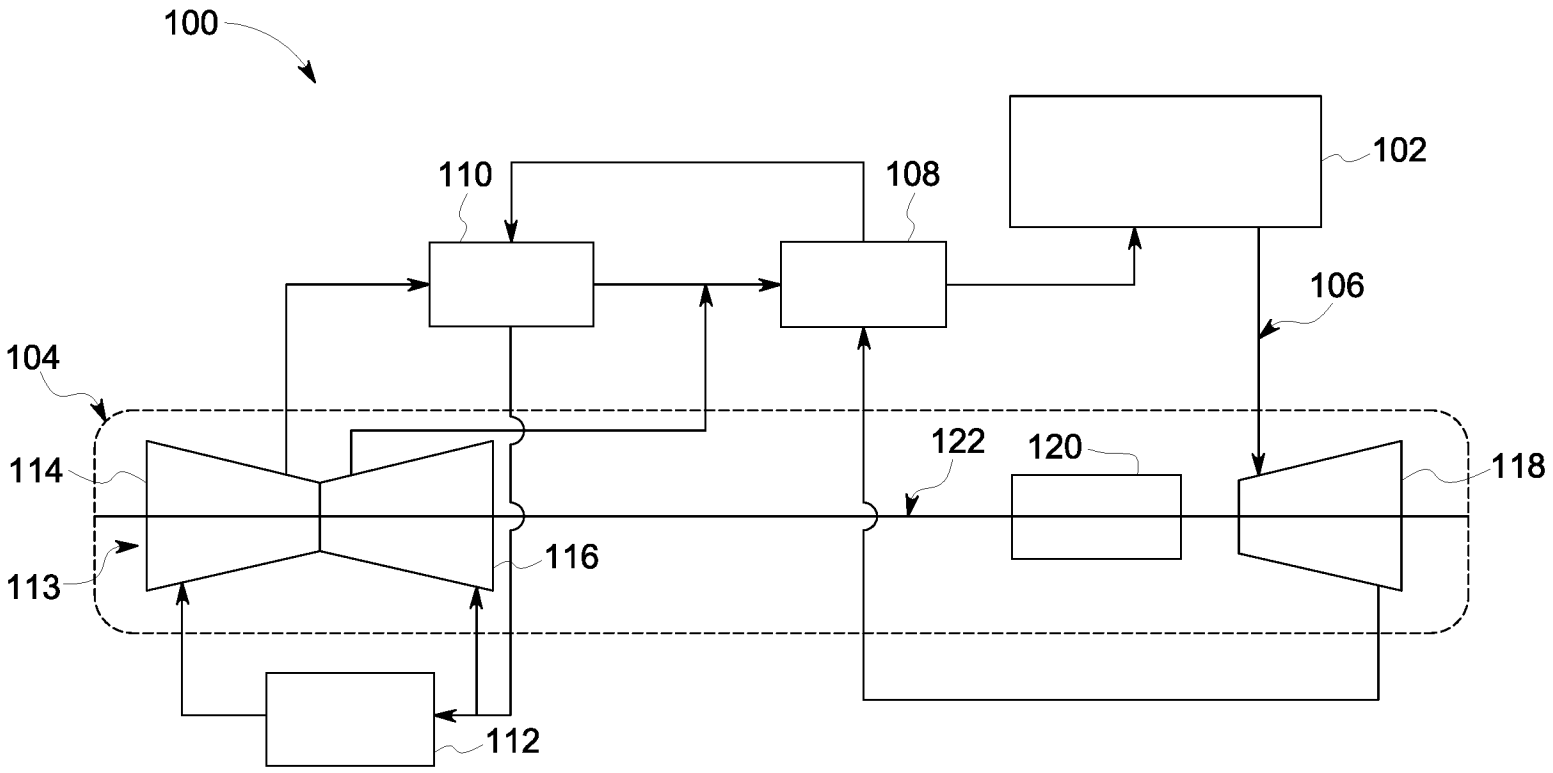
FIG. 1 is a schematic diagram of an exemplary power generation system that includes an exemplary turbomachine.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise.

"Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise.

The turbomachines, compressors, and compressor impellers as described herein overcome a number of deficiencies associated with known systems and apparatus. Specifically, the compressor impeller configurations described herein includes modifications to the arrangement of the impellers to a back-to-back impeller configuration. More specifically, compressor impeller configurations described herein include combining the highest pressure stages of the main and bypass compressors in a back-to-back configuration to avoid exposure of the back face of the impellers to the high pressure fluid. Since the exit pressures from the back-to-back compressor stages are substantially similar, a simple seal is positioned between the impellers of the two compressors to substantially prevent fluid leakage from the discharge of one compressor to the other. As such, the compressor impeller configurations as described herein substantially eliminate windage losses on the impeller back faces by combining the back faces of the main compressor and the bypass compressor such that neither are exposed to the dense high pressure fluids. Furthermore, the efficiency of the compressor and the overall power cycle are improved. In addition to being implemented for the highest pressure stages in a compressor, this configuration is also applicable to other stages of the compressors as long as the intermediate stage exit pressures are reasonably matched between the main and bypass compressors.

FIG. 1 is a simple schematic diagram of an exemplary power generation system 100 that uses at least one turbo-expander-based process to convert thermal energy into electric power. In the exemplary embodiment, power generation system 100 is a concentrated solar power plant that uses a solar receiver 102 as a heat generation source. Power generation system 100 also includes a turbomachine 104 that is a supercritical carbon dioxide ("$sCO_2$") hot-gas turboexpander operating on a recompression closed-loop $sCO_2$ Brayton power conversion cycle as a power generation source. In alternative embodiments, the methods and apparatus as described herein may be used with any conventional power generation system with a heat generation source in any suitable configuration including, but not limited to, geothermal, fossil fuel combustion, biofuel, nuclear heat, waste heat from gas turbine or internal combustion engines, and other industrial processes. Before describing turbomachine 104 in detail, other parts of power generation system 100 are first described to provide context for this embodiment of turbomachine 104. Power generation system 100 may include any number of other components, for example, and without limitation, additional recuperators, additional precoolers, and/or one or more pumps.

In the exemplary embodiment, a Brayton-cycle working fluid, e.g., $sCO_2$, is used as both the heat transfer fluid in solar receiver 102 and the working fluid in turbomachine 104. Solar receiver 102 is used to provide thermal energy to the Brayton-cycle working fluid in turbomachine 104. In general, turbomachine 104 is intended to operate in high-temperature and high-pressure conditions, for example, and without limitation, temperatures that range from and including approximately 20 degrees Celsius (° C.) (68 degrees Fahrenheit (° F.)) to and including approximately 800° C. (1,472° F.), and pressures that range from and including approximately 6.5 Megapascal (MPa), (943 pounds per square inch (psi)) to and including approximately 35.0 MPa (5,076 psi). Using solar receiver 102 in combination with turbomachine 104 facilitates efficient use of turbomachine 104 and increases the thermal energy conversion efficiency of turbomachine 104 to greater than 50%. This facilitates increasing the overall efficiency of power generation system 100, thereby reducing the system's capital costs and electricity production costs.

Power generation system 100 includes a fluid flow system 106, solar receiver 102, turbomachine 104, a high-temperature recuperator 108, low-temperature recuperator 110, and precooler 112. Turbomachine 104 includes a compressor system 113 that includes a main compressor 114 and a bypass compressor 116. Turbomachine 104 also includes an expansion turbine 118. Additionally, turbomachine 104 includes an electric power component driven by expansion turbine 118, i.e., a motor-generator 120 as described in the present embodiment, or alternatively, an alternator or pump. Motor-generator 120, expansion turbine 118, bypass compressor 116, and main compressor 114 are rotatably coupled to a rotatable shaft 122.

In operation, fluid flow system 106 guides a Brayton-cycle working fluid through power generation system 100. In one embodiment, $sCO_2$ is used as the Brayton-cycle working fluid. In some embodiments, the pressures and/or temperatures of the $CO_2$ may drop below the critical point, thereby facilitating the $CO_2$ gas condensing to a liquid and the associated compressor acting like a pumping device. Main compressor 114 and bypass compressor 116 compress the $CO_2$ from a pressure that ranges from and including approximately 6.5 MPa (943 psi) to and including approximately 12.0 MPa (1,740 psi) to a pressure that ranges from and including approximately 14.0 MPa (2030 psi) to and including approximately 35.0 MPa (5076 psi) and circulate it through fluid flow system 106. Concentrated solar energy heats the $sCO_2$ as it flows through solar receiver 102 to a temperature that ranges from and including approximately 300° C. (572° F.) to and including approximately 800° C. (1,472° F.). The $sCO_2$ leaves solar receiver 102 and is guided to expansion turbine 118 by fluid flow system 106. The $sCO_2$ enters expansion turbine 118 at a temperature that ranges from and including approximately 300° C. (572° F.) to and including approximately 800° C. (1,472° F.), and a pressure that ranges from and including approximately 14.0 MPa (2,031 psi) to and including approximately 35.0 MPa (5,076 psi).

As the $sCO_2$ flows through expansion turbine 118, it expands and releases energy, reducing the temperature of the $sCO_2$ to a range from and including approximately 200° C. (392° F.) to and including approximately 650° C. (1,202° F.), and the pressure of the $sCO_2$ to a range from and including approximately 6.5 MPa (943 psi) to and including approximately 12.0 MPa (1,740 psi). The release of the energy during the expansion process causes expansion turbine 118 to rotate, thus converting the energy to shaft work by rotating rotatable shaft 122, main compressor 114, bypass compressor 116, and the rotor component (not shown) of motor-generator 120. Motor-generator 120 converts the mechanical energy of rotatable shaft 122 to electrical energy by the relative rotation between the rotor and stator (neither shown) of motor-generator 120. This electrical energy may be directed to a power converter (not shown) and used for various purposes, including, e.g., providing electrical power to commercial and residential facilities, power storage units, etc.

After releasing energy in expansion turbine 118, the $sCO_2$ is guided by fluid flow system 106 through high-temperature recuperator 108 and low-temperature recuperator 110. High-temperature recuperator 108 and low-temperature recuperator 110 function as heat exchangers for transferring heat from the $sCO_2$ leaving expansion turbine 118 to the $sCO_2$ entering solar receiver 102, thus facilitating increasing the efficiency of power generation system 100. The $sCO_2$ exits low-temperature recuperator 110 with a temperature that ranges from and including approximately 50° C. (122° F.) to and including approximately 150° C. (302° F.) and a pressure that ranges from and including approximately 6.5 MPa (943 psi) to and including approximately 12.0 MPa (1,740 psi).

After passing through high-temperature recuperator 108 and low-temperature recuperator 110, in one embodiment, a first portion of the $sCO_2$ is guided by fluid flow system 106 through precooler 112. Precooler 112 functions as a heat exchanger for removing heat from the $sCO_2$ and transferring it to a cooling fluid. Precooler 112 may use air as its cooling fluid and rejecting the heat from the $sCO_2$ to the atmosphere. In another embodiment, precooler 112 may use water as its cooling fluid. The $sCO_2$ exits precooler 112 with a temperature that ranges from and including approximately 20° C. (68° F.) to and including approximately 100° C. (212° F.) and a pressure that ranges from and including approximately 6.5 MPa (943 psi) to and including approximately 12.0 MPa (1,740 psi). Fluid flow system 106 guides the portion of $sCO_2$ cooled by precooler 112 to main compressor 114. Main compressor 114 compresses the cooled portion of $sCO_2$ to a pressure that ranges from and including approximately 20.0 MPa (2900 psi) to and including approximately 30.0 MPa (4,351 psi), which also increases the temperature to a range from and including approximately 20° C. (68° F.) to and including approximately 150° C. (302° F.). Fluid flow system 106 then guides the compressed portion of $sCO_2$ through low-temperature recuperator 110 where it is recombined with the second portion of $sCO_2$.

After passing through high-temperature recuperator 108 and low-temperature recuperator 110, the second portion of the sCO2 is guided by fluid flow system 106 through bypass compressor 116. Bypass compressor 116 compresses the second portion of sCO2 not channeled through precooler 112 to a pressure that ranges from and including approximately 20.0 MPa (2900 psi) to and including approximately 30.0 MPa (4,351 psi), which also increases the temperature to a range from and including approximately 50° C. (122° F.) to and including approximately 200° C. (302° F.).

The second portion of $sCO_2$ is then recombined with the first portion of the $sCO_2$ after the first portion of the $sCO_2$ exits low-temperature recuperator 110 but before the $sCO_2$ enters high-temperature recuperator 108. The recombined $sCO_2$ has a pressure that ranges from and including approximately 20.0 MPa (2900 psi) to and including approximately 30.0 MPa (4,351 psi), and a temperature that ranges from and including approximately 50° C. (122° F.) to and including approximately 200° C. (302° F.).

The recombined $sCO_2$ is guided through high-temperature recuperator 108 and exits with a temperature that ranges from and including approximately 300° C. (572° F.) to and including approximately 800° C. (1,472° F.) and a pressure that ranges from and including approximately 20.0 MPa (2900 psi) to and including approximately 30.0 MPa (4,351 psi). The $sCO_2$ is then guided through solar receiver 102 to repeat the power cycle.

Figure 2:
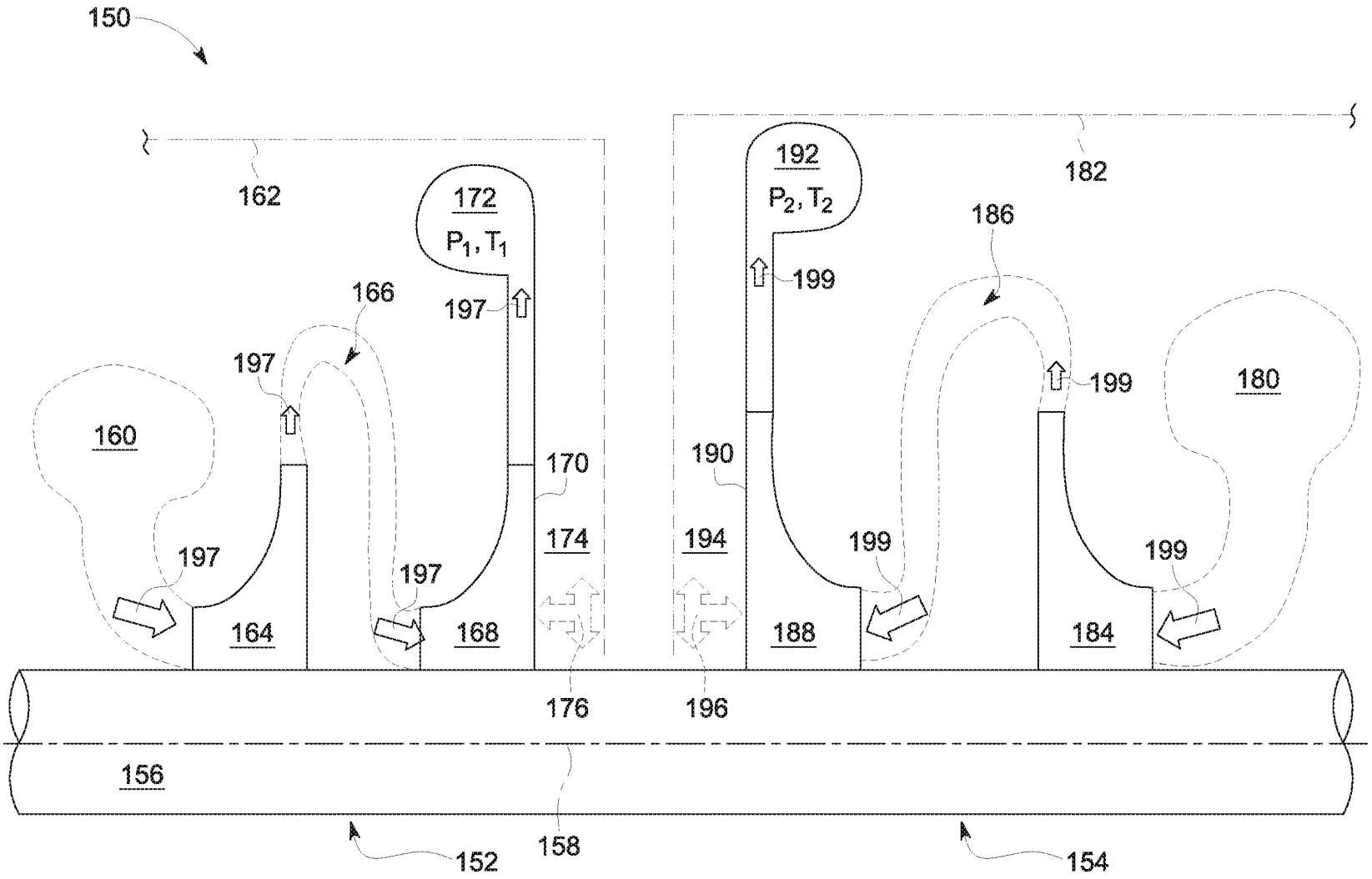
FIG. 2 (PRIOR ART)
FIG. 2 is a schematic cross-sectional view of a known compressor system including a known configuration of compressor impellers within a known turbomachine.

FIG. 2 is a schematic cross-sectional view of a known compressor system 150 including a known configuration of compressor impellers (discussed further below) within a known turbomachine (not shown). Compressor system 150 includes a main compressor 152 rotatably coupled to a bypass compressor 154 through a rotatable shaft 156. As shown, rotatable shaft 156 is a unitarily formed rotor including both main compressor 152 and bypass compressor 154. Alternatively, main compressor 152 and bypass compressor 154 are rotatably coupled through shafts for each compressor and devices that include, without limitation, flanges and coupling hardware therethrough. Rotatable shaft 156 defines a centerline axis 158.

Main compressor 152 includes a fluid inlet plenum 160 defined by a main compressor casing 162. Main compressor 152 also includes a first stage impeller 164 coupled in flow communication with fluid inlet 160 plenum. Main compressor 152 further includes a return channel 166 coupled in flow communication with first stage impeller 164 and defined by main compressor casing 162. Moreover, main compressor 152 includes a second and final stage impeller 168 coupled in flow communication with return channel 166. Final stage impeller 168 includes a back face 170. Furthermore, main compressor 152 includes a fluid exit volute 172 coupled in flow communication with final stage impeller 168 and defined by main compressor casing 162. Main compressor casing 162 and back face 170 define a windage loss region 174 that facilitates windage losses 176 due to the increased density of the working fluid channeled therethrough, e.g., $sCO_2$.

Bypass compressor 154 includes a fluid inlet plenum 180 defined by a bypass compressor casing 182. Bypass compressor 154 also includes a first stage impeller 184 coupled in flow communication with fluid inlet plenum 180. Bypass compressor 154 further includes a return channel 186 coupled in flow communication with first stage impeller 184 and defined by main compressor casing 182. Moreover, bypass compressor 154 includes a second and final stage impeller 188 coupled in flow communication with return channel 186. Final stage impeller 188 includes a back face 190. Furthermore, bypass compressor 154 includes a fluid exit volute 192 coupled in flow communication with final stage impeller 188 and defined by bypass compressor casing 182. Bypass compressor casing 182 and back face 190 define a windage loss region 194 that facilitates windage losses 196 due to the increased density of the working fluid channeled therethrough, e.g., $sCO_2$.

In operation, main compressor 152 receives $sCO_2$ 197 from a power generation system device similar to precooler 112 (shown in FIG. 1) within a power generation system similar to power generation system 100 (shown in FIG. 1). $sCO_2$ 197 is serially channeled and compressed through first stage impeller 164, return channel 166, final stage impeller 168, and fluid exit volute 172. While main compressor 152 is shown as a two-stage compressor, main compressor 152 may have three or more stages, i.e., multiple first stage impellers. $sCO_2$ 197 exits main compressor 152 at a first pressure P1 and a first temperature T1, e.g., and without limitation, first pressure P1 within a pressure range extending from and including approximately 20.0 MPa (2900 psi) to and including approximately 30.0 MPa (4,351 psi), and first temperature T1 within a temperature range extending from and including approximately 20° C. (68° F.) to and including approximately 150° C. (302° F.). Also, in operation, windage losses 176 are induced within windage loss region 174 through interaction of $sCO_2$ 197 inducing friction losses on back face 170.

Further, in operation, bypass compressor 154 receives $sCO_2$ 199 from a power generation system device similar to low-temperature recuperator 110 (shown in FIG. 1) within the power generation system similar to power generation system 100. $sCO_2$ 199 is serially channeled and compressed through first stage impeller 184, return channel 186, final stage impeller 188, and fluid exit volute 192. While bypass compressor 154 is shown as a two-stage compressor, bypass compressor 154 may have three or more stages, i.e., multiple first stage impellers. $sCO_2$ 199 exits bypass compressor 154 at a second pressure P2 and a second temperature T2, e.g., and without limitation, second pressure P2 within a pressure range extending from and including approximately 20.0 MPa (2900 psi) to and including approximately 30.0 MPa (4,351 psi), and second temperature T2 within a temperature range extending from and including approximately 50° C. (122° F.) to and including approximately 200° C. (392° F.). Also, in operation, windage losses 196 are induced within windage loss region 194 through interaction of $sCO_2$ 199 inducing friction losses on back face 190. First pressure P1 and second pressure P2 are substantially similar and first temperature T1 and second temperature T2 are different.

Figure 3:
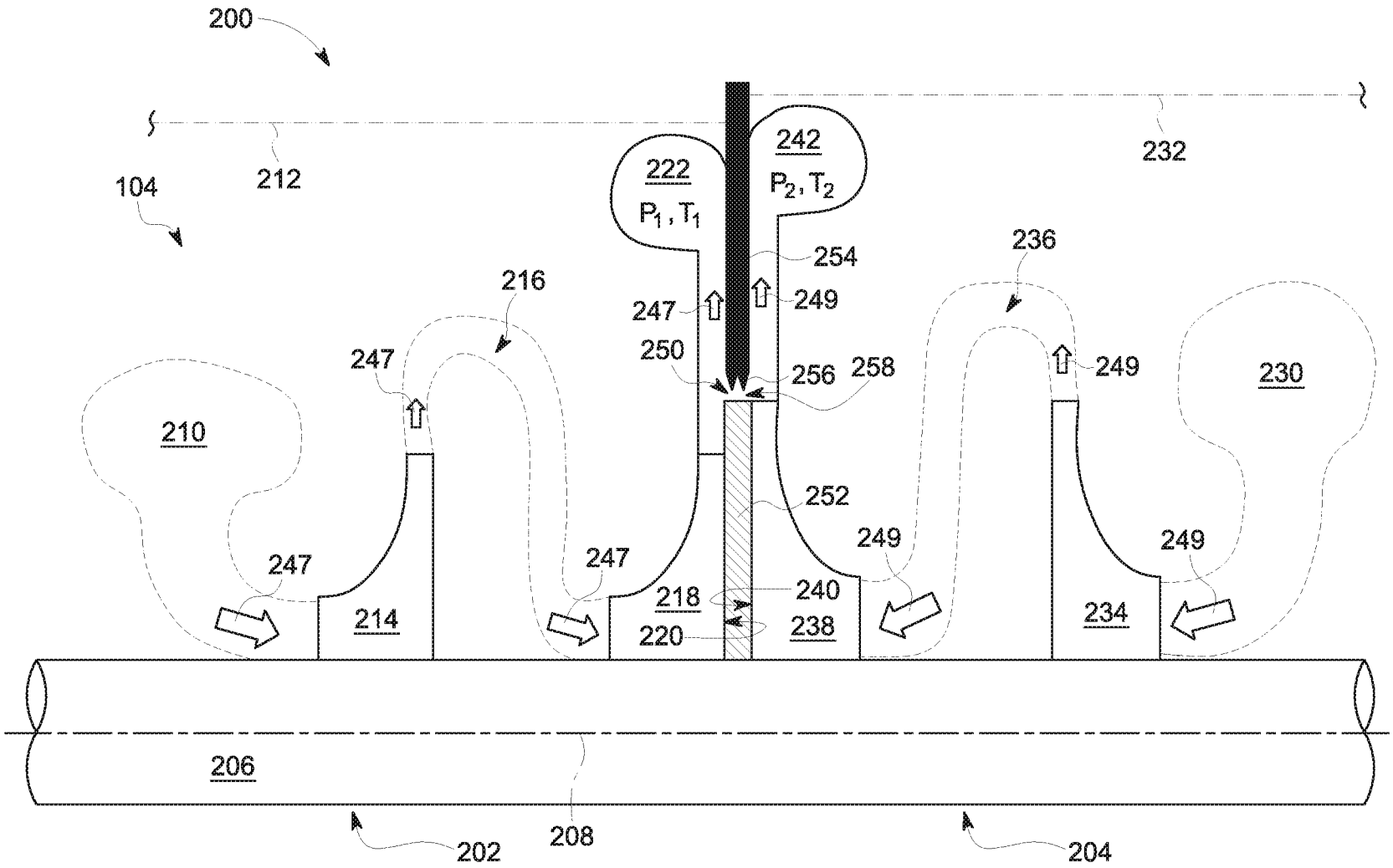
FIG. 3 is a schematic cross-sectional view of an exemplary compressor system including an exemplary configuration of compressor impellers used within the turbomachine shown in FIG. 1.

FIG. 3 is a schematic cross-sectional view of an exemplary compressor system 200 including an exemplary configuration of compressor impellers (discussed further below) used within turbomachine 104. Compressor system 200 includes a first compressor assembly, i.e., a main compressor 202 rotatably coupled to a second compressor assembly, i.e., a bypass compressor 204 through a rotatable shaft 206. As shown, rotatable shaft 206 is a unitarily formed rotor including both main compressor 202 and bypass compressor 204. Alternatively, main compressor 202 and bypass compressor 204 are rotatably coupled through shafts for each compressor and devices that include, without limitation, flanges and coupling hardware therethrough. Rotatable shaft 206 defines a centerline axis 208.

Main compressor 202 includes a fluid inlet plenum 210 defined by a main compressor casing 212. Main compressor 202 also includes a first stage impeller 214 coupled in flow communication with fluid inlet 210 plenum. Main compressor 202 further includes a return channel 216 coupled in flow communication with first stage impeller 214 and defined by main compressor casing 212. Moreover, main compressor 202 includes a second and final stage impeller 218 coupled in flow communication with return channel 216. Final stage impeller 218 includes a first back face 220. Furthermore, main compressor 202 includes a first fluid exit volute 222 coupled in flow communication with final stage impeller 218 and defined by main compressor casing 212. In the exemplary embodiment, main compressor 202 includes two stages. Alternatively, main compressor 202 has any number of stages that enable operation of compressor system 200 and turbomachine 104 as described herein, including, without limitation, three stages and above.

Bypass compressor 204 includes a fluid inlet plenum 230 defined by a bypass compressor casing 232. Bypass compressor 204 also includes a first stage impeller 234 coupled in flow communication with fluid inlet 230 plenum. Bypass compressor 204 further includes a return channel 236 coupled in flow communication with first stage impeller 234 and defined by main compressor casing 232. Moreover, bypass compressor 204 includes a second and final stage impeller 238 coupled in flow communication with return channel 236. Final stage impeller 238 includes a second back face 240 that opposes first back face 220. Furthermore, bypass compressor 204 includes a second fluid exit volute 242 coupled in flow communication with final stage impeller 238 and defined by bypass compressor casing 232. In the exemplary embodiment, bypass compressor 204 includes two stages. Alternatively, bypass compressor 204 has any number of stages that enable operation of compressor system 200 and turbomachine 104 as described herein, including, without limitation, three stages and above.

Compressor system 200 also includes a sealing system 250 that includes a rotatable member 252 coupled to rotatable shaft 206 and a radially opposing, stationary member 254 coupled to one or more of main compressor casing 212 and bypass compressor casing 232 (shown coupled to both). Stationary member 254 includes a labyrinth seal assembly 256 that defines a tortuous flow path 258 (shown exaggerated in radial height for clarity). In the exemplary embodiment, sealing system 250 is sufficiently robust to withstand a predetermined differential pressure between first fluid exit volute 222 and second fluid exit volute 242 while facilitating some pressure equalization through tortuous flow path 258. Rotatable member 252 is rotatably coupled to back face 220 of final stage impeller 218 and back face 240 of final stage impeller 238. As such, compressor system does not define any windage loss regions such as regions 174 and 194 (both shown in FIG. 2), thereby substantially eliminating windage losses such as losses 176 and 196 (both shown in FIG. 2).

In operation, main compressor 202 receives a first working fluid, i.e., $sCO_2$ 247 from precooler 112 (shown in FIG. 1). $sCO_2$ 247 is serially channeled and compressed through first stage impeller 214, return channel 216, final stage impeller 218, and fluid exit volute 222. $sCO_2$ 247 exits main compressor 202 at a first pressure P1 and a first temperature T1, e.g., and without limitation, first pressure P1 within a pressure range extending from and including approximately 20.0 MPa (2900 psi) to and including approximately 30.0 MPa (4,351 psi), and first temperature T1 within a temperature range extending from and including approximately 20° C. (68° F.) to and including approximately 150° C. (302° F.).

Further, in operation, bypass compressor 204 receives a second working fluid, i.e., $sCO_2$ 249 from low-temperature recuperator 110 (shown in FIG. 1). $sCO_2$ 249 is serially channeled through and compressed first stage impeller 234, return channel 236, final stage impeller 238, and fluid exit volute 242. $sCO_2$ 249 exits bypass compressor 204 at a second pressure P2 and a second temperature T2, e.g., and without limitation, second pressure P2 within a pressure range extending from and including approximately 20.0 MPa (2900 psi) to and including approximately 30.0 MPa (4,351 psi), and second temperature T2 within a temperature range extending from and including approximately 50° C. (122° F.) to and including approximately 200° C. (392° F.). First pressure P1 and second pressure P2 are substantially similar and first temperature T1 and second temperature T2 are different, therefore, sealing system 250 substantially isolates first $sCO_2$ 247 from second $sCO_2$ 249 and the associated temperature differences from each other. Also, for those embodiments where first $sCO_2$ 247 has a first flow rate that is different form a second flow rate of second $sCO_2$ 249, sealing system 250 substantially isolates first $sCO_2$ 247 from second $sCO_2$ 249.

Figure 4:
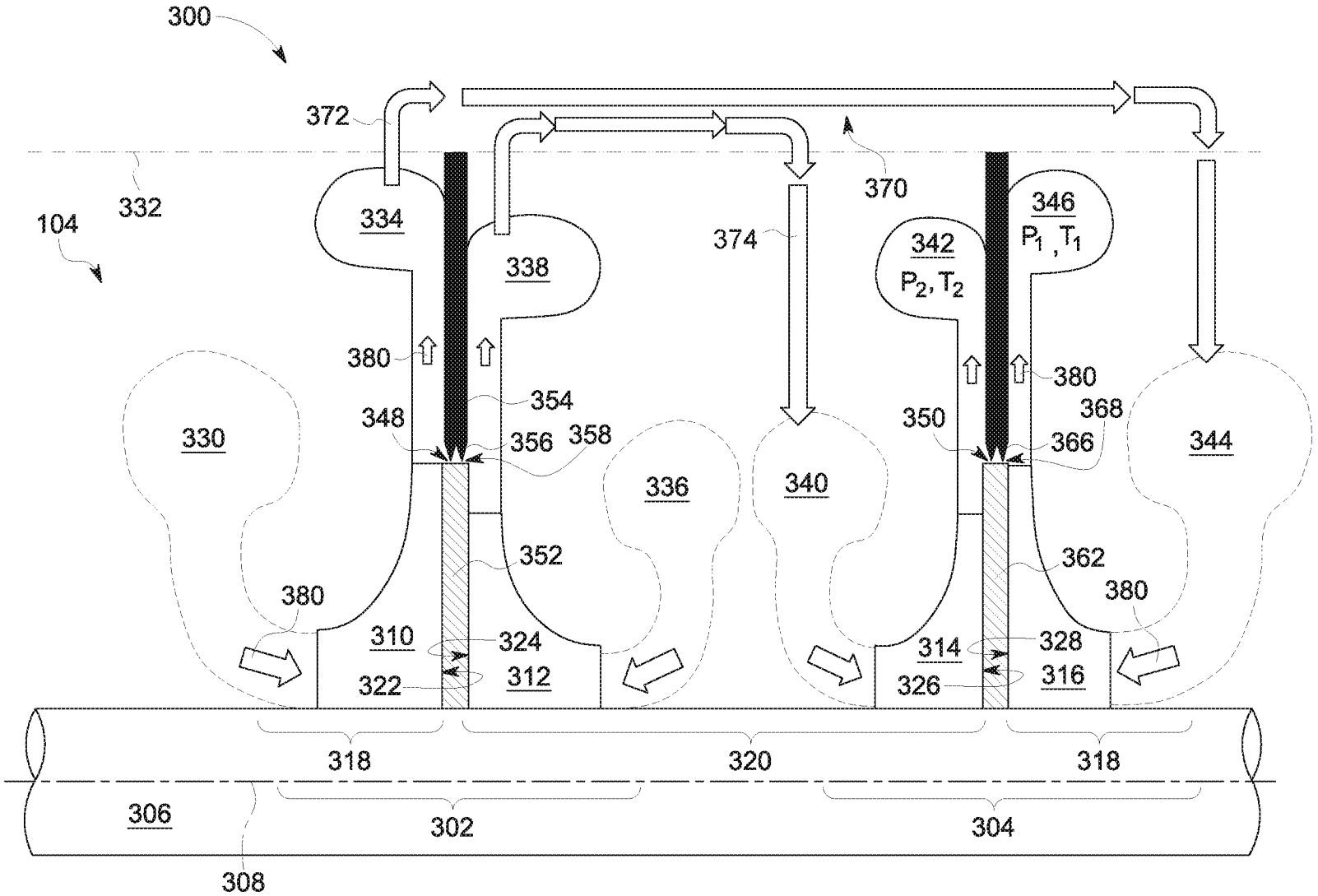
FIG. 4 is a schematic cross-sectional view of an alternative compressor system including an alternative configuration of compressor impellers used within the turbomachine shown in FIG. 1.

FIG. 4 is a schematic cross-sectional view of an alternative compressor system 300 including an alternative configuration of compressor impellers (discussed further below) used within turbomachine 104. In this alternative embodiment, compressor system 300 includes a first compressor assembly, i.e., a first back-to-back compressor assembly 302 and a second compressor assembly, i.e., a second back-to-back compressor assembly 304. First back-to-back compressor assembly 302 and second back-to-back compressor assembly 304 are rotatably coupled to each other through a rotatable shaft 206. As shown, rotatable shaft 306 is a unitarily formed rotor including both first back-to-back compressor assembly 302 and second back-to-back compressor assembly 304. Alternatively, first back-to-back compressor assembly 302 and second back-to-back compressor assembly 304 are rotatably coupled through shafts for each compressor and devices that include, without limitation, flanges and coupling hardware therethrough. Rotatable shaft 306 defines a centerline axis 308.

In this alternative embodiment, compressor system 300 is a hybrid compressor system. Specifically, first back-to-back compressor assembly 302 includes a first compressor impeller 310 and a second compressor impeller 312. Second back-to-back compressor assembly 304 includes a third compressor impeller 314 and a fourth compressor impeller 316. First compressor impeller 310 and fourth compressor impeller 316 at least partially define a main compressor system 318. Similarly, second compressor impeller 312 and third compressor impeller 314 at least partially define a bypass compressor system 320. As such, first compressor impeller 310 is a first main compressor impeller, second compressor impeller 312 is a first bypass compressor impeller, third compressor impeller 314 is a second bypass compressor impeller, and fourth compressor impeller 316 is a second main compressor impeller. First compressor impeller 310 includes a first back face 322, second compressor impeller 312 includes a second back face 324, third compressor impeller 314 includes a third back face 326, and third compressor impeller 316 includes a fourth back face 328. First back face 322 and second back face 324 are opposing and third back face 326 and fourth back face 328 are opposing.

Also, in this alternative embodiment, main compressor system 318, and first back-to-back compressor assembly 302, includes a first main compressor fluid inlet plenum 330 defined by a compressor casing 332. First compressor impeller 310 is coupled in flow communication with fluid inlet plenum 330. Furthermore, main compressor system 318 includes a first main compressor fluid outlet volute 334 coupled in flow communication with first compressor impeller 310. Bypass compressor system 320, and first back-to-back compressor assembly 302, includes a first bypass compressor fluid inlet plenum 336 defined by compressor casing 332. Second compressor impeller 312 is coupled in flow communication with fluid inlet plenum 336. Furthermore, bypass compressor system 320 includes a first bypass compressor fluid outlet volute 338 coupled in flow communication with second compressor impeller 312.

Further, in this alternative embodiment, bypass compressor system 320, and second back-to-back compressor assembly 304, includes a second bypass compressor fluid inlet plenum 340 defined by compressor casing 332. Third compressor impeller 314 is coupled in flow communication with fluid inlet plenum 340. Furthermore, bypass compressor system 320 includes a second bypass compressor fluid outlet volute 342 coupled in flow communication with third compressor impeller 314. Main compressor 318, and second back-to-back compressor assembly 304, includes a second main compressor fluid inlet plenum 344 defined by compressor casing 332. Fourth compressor impeller 316 is coupled in flow communication with fluid inlet plenum 344. Furthermore, main compressor system 318 includes a second main compressor fluid outlet volute 346 coupled in flow communication with fourth compressor impeller 316.

Compressor system 300 also includes a plurality of sealing system 348 and 350. Specifically, first back-to-back compressor assembly 302 includes first back-to-back compressor assembly sealing system 348 and second back-to-back compressor assembly 304 includes second back-to-back compressor assembly sealing system 350. First sealing system 348 includes a rotatable member 352 coupled to rotatable shaft 306 and a radially opposing, stationary member 354 coupled to compressor casing 312. Stationary member 354 includes a labyrinth seal assembly 356 that defines a tortuous flow path 358 (shown exaggerated in radial height for clarity). In the exemplary embodiment, sealing system 350 is sufficiently robust to withstand a predetermined differential pressure between first main compressor fluid outlet volute 334 and first bypass compressor fluid outlet volute 338 while facilitating some pressure equalization through tortuous flow path 358. Rotatable member 352 is rotatably coupled to first back face 322 of first compressor impeller 310 and second back face 324 of second compressor impeller 312.

Similarly, second sealing system 350 includes a rotatable member 362 coupled to rotatable shaft 306 and a radially opposing, stationary member 364 coupled to compressor casing 312. Stationary member 364 includes a labyrinth seal assembly 366 that defines a tortuous flow path 368 (shown exaggerated in radial height for clarity). In the exemplary embodiment, sealing system 360 is sufficiently robust to withstand a predetermined differential pressure between second bypass compressor fluid outlet volute 342 and second main compressor fluid outlet volute 346 while facilitating some pressure equalization through tortuous flow path 368. Rotatable member 362 is rotatably coupled to third back face 326 of third compressor impeller 314 and fourth back face 328 of fourth compressor impeller 316. As such, compressor system 300 does not define any windage loss regions such as regions 174 and 194 (both shown in FIG. 2), thereby substantially eliminating windage losses such as losses 176 and 196 (both shown in FIG. 2).

Moreover, in this alternative embodiment, compressor system 300 includes a piping system 370 configured to couple first back-to-back compressor assembly 302 in flow communication with second back-to-back compressor assembly 304. Specifically, piping system 370 includes a first piping assembly 372 coupling first main compressor fluid outlet volute 334 with second main compressor fluid inlet plenum 344. Also, specifically, piping system 370 includes a second piping assembly 374 coupling first bypass compressor fluid outlet volute 338 with second bypass compressor fluid inlet plenum 340. As shown, piping system 370 is external to casing 332. However, some embodiments include internal fluid channeling systems that perform similar functions.

In operation, first main compressor fluid inlet plenum 330 receives a first working fluid, i.e., $sCO_2$ 380 from precooler 112 (shown in FIG. 1) enters main compressor system 318 (first back-to-back compressor assembly 302). $sCO_2$ 380 is serially channeled and compressed through first compressor impeller 310, first main compressor fluid outlet volute 334, first piping assembly 372, second main compressor fluid inlet plenum 344, fourth compressor impeller 316, and second main compressor fluid outlet volute 346. $sCO_2$ 380 exits main compressor system 318 (second back-to-back compressor assembly 304) at a first pressure P1 and a first temperature T1, e.g., and without limitation, first pressure P1 within a pressure range extending from and including approximately 20.0 MPa (2900 psi) to and including approximately 30.0 MPa (4,351 psi), and first temperature T1 within a temperature range extending from and including approximately 20° C. (68° F.) to and including approximately 150° C. (302° F.).

Further, in operation, first bypass compressor fluid inlet plenum 336 receives a second working fluid, i.e., $sCO_2$ 382 from low-temperature recuperator 110 (shown in FIG. 1) enters bypass compressor system 320 (first back-to-back compressor assembly 302). $sCO_2$ 382 is serially channeled and compressed through second compressor impeller 312, first bypass compressor fluid outlet volute 338, second piping assembly 374, second bypass compressor fluid inlet plenum 340, third compressor impeller 314, and second bypass compressor fluid outlet volute 342. $sCO_2$ 382 exits bypass compressor system 320 (second back-to-back compressor assembly 304) at a second pressure P2 and a second temperature T2, e.g., and without limitation, second pressure P2 within a pressure range extending from and including approximately 20.0 MPa (2900 psi) to and including approximately 30.0 MPa (4,351 psi), and second temperature T2 within a temperature range extending from and including approximately 50° C. (122° F.) to and including approximately 200° C. (392° F.). First pressure P1 and second pressure P2 are substantially similar and first temperature T1 and second temperature T2 are different, therefore, sealing systems 348 and 350 substantially isolates first $sCO_2$ 380 from second $sCO_2$ 382 and the associated temperature differences from each other. Also, for those embodiments where first $sCO_2$ 380 has a first flow rate that is different form a second flow rate of second $sCO_2$ 382, sealing systems 348 and 350 substantially isolates first $sCO_2$ 380 from second $sCO_2$.

In this alternative embodiment, main compressor system 318 and bypass compressor system 320 include two stages each. Alternatively, main compressor system 318 and bypass compressor system 320 have any number of stages that enable operation of compressor system 300 and turbomachine 104 as described herein, including, without limitation, three stages and above. Also, alternatively, any number of stages may be cross-connected to achieve the desired pressures and temperatures.

The above described turbomachines, compressors, and compressor impellers overcome a number of deficiencies associated with known systems and apparatus. Specifically, the compressor impeller configurations described herein includes modifications to the arrangement of the impellers to a back-to-back impeller configuration. More specifically, compressor impeller configurations described herein include combining the highest pressure stages of the main and bypass compressors in a back-to-back configuration to avoid exposure of the back face of the impellers to the high pressure fluid. Since the exit pressures from the back-to-back compressor stages are substantially similar, a simple seal is positioned between the impellers of the two compressors to substantially prevent fluid leakage from the discharge of one compressor to the other. As such, the compressor impeller configurations as described herein substantially eliminate windage losses on the impeller back faces by combining the back faces of the main compressor and the bypass compressor such that neither are exposed to the dense high pressure fluids. Furthermore, the efficiency of the compressor and the overall power cycle are improved. In addition to being implemented for the highest pressure stages in a compressor, this configuration is also applicable to other stages of the compressors as long as the intermediate stage exit pressures are reasonably matched between the main and bypass compressors.

An exemplary technical effect of the methods, systems, and apparatus described herein includes at least one of: (a) substantially eliminating impeller back face windage losses in compressor systems with multiple compressors through back-to-back impeller configurations that remove exposure of the back faces of the impellers to the high pressure working fluids; and (b) increasing the overall efficiency of turbomachines with compressors.

Exemplary embodiments of turbomachines operating at high temperatures and high pressures are described above in detail. The methods and systems are not limited to the specific embodiments described herein, but rather, components of systems and/or steps of the methods may be utilized independently and separately from other components and/or steps described herein. For example, the methods may also be used in combination with other high-temperature and high-pressure turbomachine systems and methods, and are not limited to practice with only the components, materials, and methods as described herein.

Although specific features of various embodiments of the disclosure may be shown in some drawings and not in others, this is for convenience only. In accordance with the principles of the disclosure, any feature of a drawing may be referenced and/or claimed in combination with any feature of any other drawing.

This written description uses examples to disclose the embodiments, including the best mode, and also to enable any person skilled in the art to practice the embodiments, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A compressor system comprising:

a first compressor assembly comprising at least one first impeller, said first compressor assembly defining at least one first volute configured to receive a first working fluid from said at least one first impeller at a first pressure and a first temperature, said at least one first volute comprising a first main compressor volute and a second main compressor volute;

a second compressor assembly rotatably coupled to said first compressor assembly, said second compressor assembly comprising at least one second impeller rotatably coupled to said at least one first impeller, said second compressor assembly defining at least one second volute configured to receive a second working fluid from said at least one second impeller at a second pressure, said at least one second volute comprising a first bypass compressor volute and a second bypass compressor volute, wherein said at least one first impeller comprises a first back face and said at least one second impeller comprises a second back face spatially opposed to and facing said first back face, wherein said at least one first impeller is a first last stage impeller and said at least one second impeller is a second last stage impeller, and wherein at least one of: i) the first pressure is different from the second pressure and ii) the first temperature is different from the second temperature; and at least one sealing system coupled to said first back face of said at least one first impeller and said second back face of said at least one second impeller to substantially fluidly isolate the first working fluid circulating within said first compressor assembly from the second working fluid circulating within said second compressor assembly, wherein each of said at least one sealing system comprises a rotatable member and a stationary member that define a tortuous flow path therebetween, the tortuous flow path located proximate an outer diameter of at least one of said at least one first impeller and said at least one second impeller, and wherein said at least one sealing system comprises:

a first sealing system defining a first tortuous flow path extending between said first main compressor volute and said first bypass compressor volute; and a second sealing system defining a second tortuous flow path extending between said second main compressor volute and said second bypass compressor volute.

2. The compressor system in accordance with claim 1, further comprising:

a first piping assembly coupling said first main compressor volute in flow communication with a second main compressor impeller; and a second piping assembly coupling said first bypass compressor volute in flow communication with a second bypass compressor impeller.

3. The compressor system in accordance with claim 1, wherein said first compressor assembly is a main compressor that receives the first working fluid from a precooler and said second compressor assembly is a bypass compressor that receives the second working fluid from a low-temperature recuperator.

4. The compressor system of claim 1, wherein the first working fluid and the second working fluid are carbon dioxide ($CO_2$).

5. The compressor system of claim 4, wherein the first working fluid and the second working fluid are supercritical $CO_2$ ($sCO_2$).

6. The compressor system of claim 1, wherein the flow path defined by said at least one sealing system is located radially outward of said at least one first impeller and said at least one second impeller.

7. A turbomachine for use with a working fluid comprising:

a rotatable shaft; and a compressor system coupled to said rotatable shaft, said compressor system comprising:

a first compressor assembly comprising at least one first impeller, said first compressor assembly defining at least one first volute configured to receive a first working fluid from said at least one first impeller at a first pressure and a first temperature, said at least one first volute comprising a first main compressor volute and a second main compressor volute;

a second compressor assembly rotatably coupled to said first compressor assembly, said second compressor assembly comprising at least one second impeller rotatably coupled to said at least one first impeller, said second compressor assembly defining at least one second volute configured to receive a second working fluid from said at least one second impeller at a second pressure, said at least one second volute comprising a first bypass compressor volute and a second bypass compressor volute, wherein said at least one first impeller comprises a first back face and said at least one second impeller comprises a second back face in spatial opposition to and facing said first back face, and wherein at least one of: i) the first pressure is different from the second pressure, and ii) the first temperature is different from the second temperature; and at least one sealing system coupled to said first back face of said at least one first impeller and said second back face of said at least one second impeller to reduce a windage loss region defined between said first back face and said second back face, wherein said at least one sealing system substantially fluidly isolates the first working fluid circulating within said first compressor assembly from the second working fluid circulating within said second compressor assembly, wherein each of said at least one sealing system comprises a rotatable member and a stationary member that define a tortuous flow path therebetween, the tortuous flow path located proximate an outer diameter of at least one of said at least one first impeller and said at least one second impeller, and wherein said at least one sealing system comprises:

a first sealing system defining a first tortuous flow path extending between said first main compressor volute and said first bypass compressor volute; and a second sealing system defining a second tortuous flow path extending between said second main compressor volute and said second bypass compressor volute.

8. The turbomachine in accordance with claim 7, further comprising:

a first piping assembly coupling said first main compressor volute in flow communication with a second main compressor impeller; and a second piping assembly coupling said first bypass compressor volute in flow communication with a second bypass compressor impeller.

9. The turbomachine in accordance with claim 7, wherein said first compressor assembly is a main compressor that receives the first working fluid from a precooler and said second compressor assembly is a bypass compressor that receives the second working fluid from a low-temperature recuperator.

10. A method of pressurizing a working fluid within a turbomachine that includes a rotatable shaft, said method comprising:

rotating the rotatable shaft comprising:

rotating a first compressor assembly including at least one first impeller having a first back face; and rotating a second compressor assembly, the second compressor assembly including at least one second impeller having a second back face spatially opposed to and facing the first back face, the second impeller rotatably coupled to the at least one first impeller, the second compressor assembly further including a first bypass compressor volute and a second bypass compressor volute;

contacting the first back face of the at least one first impeller to at least one sealing system; and contacting the second back face of the at least one second impeller to the at least one sealing system to reduce a windage loss region defined between the first back face and the second back face, the at least one sealing system substantially fluidly isolating the first compressor assembly from the second compressor assembly;

channeling a first working fluid having a first temperature to the at least one first impeller;

pressurizing the first working fluid to a first pressure, the working fluid at the first pressure channeled to a first main compressor volute and a second main compressor volute of the first compressor assembly, wherein each of the at least one sealing system includes a rotatable member and a stationary member that define a tortuous flow path therebetween, the tortuous flow path located proximate an outer diameter of at least one of the at least one first impeller and the at least one second impeller, and wherein the at least one sealing system includes i) a first sealing system defining a first tortuous flow path extending between the first main compressor volute and the first bypass compressor volute, and ii) a second sealing system defining a second tortuous flow path extending between the second main compressor volute and the second bypass compressor volute; and at least one of:

channeling a second working fluid having a second temperature different from the first temperature to the at least one second impeller; and pressurizing the second working fluid to a second pressure different from the first pressure.

* * * * *